US008529319B2

(12) United States Patent
Gaspich et al.

(10) Patent No.: US 8,529,319 B2
(45) Date of Patent: Sep. 10, 2013

(54) UNIVERSAL BUSHING FOR ABRASIVE WHEELS

(75) Inventors: Deborah Anne Gaspich, Jordan (CA); David J. Long, Shrewsbury, MA (US)

(73) Assignees: Saint-Gobain Abrasives, Inc., Worcester, MA (US); Saint-Gobain Abrasifs, Conflans-Sainte-Honorine (FR)

( * ) Notice: Subject to any disclaimer, the term of this patent is extended or adjusted under 35 U.S.C. 154(b) by 671 days.

(21) Appl. No.: 12/069,221

(22) Filed: Feb. 8, 2008

(65) Prior Publication Data

US 2008/0194190 A1 Aug. 14, 2008

Related U.S. Application Data

(60) Provisional application No. 60/900,629, filed on Feb. 9, 2007.

(51) Int. Cl.
*B24B 45/00* (2006.01)

(52) U.S. Cl.
USPC ..... 451/508; 16/2.1; 384/296; 451/541; 451/548

(58) Field of Classification Search
USPC ..... 16/2.1, 2.2, 2.4, 2.5; 384/280, 281, 384/282, 296, 297; 451/342, 490, 508, 541, 451/548
See application file for complete search history.

(56) References Cited

U.S. PATENT DOCUMENTS

| | | | | | |
|---|---|---|---|---|---|
| 11,510 | A * | 8/1854 | Taylor | 384/296 |
| 2,726,493 | A | 12/1953 | Young et al. | |
| 3,136,100 | A * | 6/1964 | Robertson, Jr. | 451/548 |
| 3,193,335 | A * | 7/1965 | Wing | 384/296 |
| 4,637,170 | A * | 1/1987 | Block | 451/342 |
| 4,655,006 | A * | 4/1987 | Block | 451/342 |
| 5,152,106 | A * | 10/1992 | MacKay, Jr. | 451/342 |
| 5,330,273 | A * | 7/1994 | Tsai | 384/215 |
| 5,651,726 | A * | 7/1997 | Skogsberg | 451/342 |
| 6,138,317 | A * | 10/2000 | Holmes et al. | 15/180 |
| 6,942,561 | B2 * | 9/2005 | Mota et al. | 451/541 |
| 7,357,702 | B2 * | 4/2008 | Ficai | 451/508 |
| 2003/0131708 | A1 | 7/2003 | Baron | |
| 2006/0185492 | A1 | 8/2006 | Chianese | |
| 2006/0266176 | A1 | 11/2006 | Brach | |

OTHER PUBLICATIONS

Donahue Industries, Inc., Reducing Adaptor Bushings, 1 page, Shrewsbury, Massachusetts.

Accessories, Nuts, Adaptors, p. 148.

Partner Industrial, A champion in a new class, 1 page, printed on Oct. 17, 2006 from Internet; http://www.partnerusa.com/node47.asp-?product_id=k950a_2002.

* cited by examiner

*Primary Examiner* — Timothy V Eley

(74) *Attorney, Agent, or Firm* — Joseph P. Sullivan; Abel Law Group, LLP

(57) ABSTRACT

Embodiments of the present invention resolve the safety and product management issues associated with conventional abrasive wheel bushings by, for example, reducing the opportunity for improperly mounting an abrasive wheel without the appropriate reducing bushing, simplifying the purchasing process, and/or reserving valuable SKU space for primary products. The abrasive wheel itself can be tailored to any number of purposes, such as grinding, cutting, and polishing. The bushing described herein can be used with any such abrasive wheels. The techniques could readily be extended to any arbor-based products that use reduction bushings or similar schemes.

10 Claims, 4 Drawing Sheets

(back view)

(front view)

(side view)

(side view)

(front view)

(cross-section side view)

(front view)

UNIVERSAL BUSHING FOR ABRASIVE WHEELS

RELATED APPLICATION

This application claims the benefit of U.S. Provisional Application No. 60/900,629, filed on Feb. 9, 2007, which is herein incorporated by reference in its entirety.

FIELD OF THE INVENTION

The invention relates to universal bushings, and more particularly, to a universal bushing for abrasive wheels.

BACKGROUND OF THE INVENTION

According to ANSI (the American National Safety Institute), a loose reducing bushing can be used to reduce the molded arbor size of a grinding wheel, but it must not exceed the width of the grinding wheel and shall not contact the mounting flanges. Currently, conventional reducing bushings are only available as distinct components, and are sold separately from the grinding wheels with which they are intended to operate. There are a number of problems associated with such conventional bushings, ranging from safety to product management.

For example, and with respect to safety, in many applications the reducing bushing is relatively thin, and inadvertently using the associated grinding wheel without the bushing in place would be easy enough to do. This is because the "play" in the unadapted grinding wheel on the arbor of the grinding machine may be slight, and therefore difficult for a machine operator to detect. In any such case, the wheel would not be properly mounted on the arbor of the grinding machine, and therefore presents a significant safety risk (particularly for high speed-wheels that become unstable and/or break apart when not properly mounted). In addition, there is a risk that the donut-like bushing will fall out during the mounting process thus allowing the wheel to not be secure on the arbor.

With respect to product management, the customer (e.g., end-user) must know to order or otherwise purchase the appropriate reducing bushing with the corresponding grinding wheel. This can be a confusing and/or tedious process that frustrates the buyer's purchasing experience. In addition, large retailers typically offer a limited number of SKU (Stock Keeping Unit) space to grinding wheel vendors. Thus, the venders are ultimately limited in the product offerings they can sell to the retailer, because the vendors use up valuable SKU space for bushings (in addition to the SKU space used for grinding wheels with which the bushings are used). As such, the vendors are limited to the amount of primary product (grinding wheels in this case) that they can sell to the grinding wheel retailer.

Such safety and product management issues associated with bushings remain unrecognized and unresolved.

SUMMARY OF THE INVENTION

One embodiment of the present invention provides an abrasive product. The product includes an abrasive wheel having an arbor hole designed to fit a machine having a first arbor size, and a removable reduction bushing pre-installed in the arbor hole of the abrasive wheel, the bushing for adapting the abrasive wheel to fit on a machine having a second arbor size. The pre-installed removable reduction bushing will not fall out of the arbor hole unless purposefully removed by applying a shear stress of 10 pounds per square inch or less under static loading for a time period in the range of about 1 to 10 seconds (this force could be achieved, for example, by pushing the bushing out of arbor hole with thumb or finger or a push-stick). In another such example embodiment, the pre-installed removable reduction bushing will not fall out of the arbor hole unless purposefully removed by applying a shear stress of 5 pounds per square inch or less under static loading for a time period in the range of about 1 to 5 seconds. The abrasive product can be associated with a single product identification code (such as a SKU or UPC) at a retail store that sells abrasive products. In one particular case, the removable reduction bushing includes a flanged portion and an O-ring portion about the flanged portion, wherein the O-ring portion fits snugly in the arbor hole. In one such case, the flanged portion is made from metal and the O-ring portion is made from plastic or rubber, and the two portions are securely coupled together. The O-ring portion may further include a friction reducing component (such as graphite or silicone). In another such case, the flanged portion and the O-ring portion are integral to one another. In one particular example case, the first arbor size and the second arbor size can be each associated with a diameter, and the two diameters are within 5 millimeters or less of one another. The abrasive wheel can be, for example, a high-speed abrasive wheel (such as a 12 or 14 inch cut-off wheel or other high-speed abrasive product).

Another embodiment of the present invention provides a device for an abrasive wheel having an arbor hole designed to fit a machine having a first arbor size. The device includes a removable reduction bushing adapted to be pre-installed in the arbor hole of the abrasive wheel, for adapting the abrasive wheel to fit on a machine having a second arbor size. Once pre-installed into the arbor hole, the removable reduction bushing is adapted to not fall out of the arbor hole unless purposefully removed by applying a shear stress of 10 pounds per square inch or less under static loading for a time period in the range of about 1 to 10 seconds. Other features discussed above with reference to the abrasive product may be equally applied here. The device has a number of applications, and is particularly useful in high-speed abrasive wheel applications (e.g., high-speed cut-off wheels in the 12 and 14 inch range). Various industry safety standards at wheel speeds typical in such applications are satisfied.

Another embodiment of the present invention provides a product identification code reduction method for abrasive wheels having an arbor hole designed to fit a machine having a first arbor size. The method includes pre-installing a removable reduction bushing in an arbor hole of an abrasive wheel, the bushing for adapting the abrasive wheel to fit on a machine having a second arbor size. Once pre-installed into the arbor hole, the removable reduction bushing is adapted to not fall out of the arbor hole unless purposefully removed by applying a shear stress of 10 pounds per square inch or less under static loading for a time period in the range of about 1 to 10 seconds. The removable reduction bushing and the abrasive wheel are associated with a single product identification code at a retail store that sells abrasive products, the single product identification code being one of a SKU or a UPC. Other features discussed above with reference to the device may be equally applied here.

The features and advantages described herein are not all-inclusive and, in particular, many additional features and advantages will be apparent to one of ordinary skill in the art in view of the drawings, specification, and claims. Moreover, it should be noted that the language used in the specification has been principally selected for readability and instructional purposes, and not to limit the scope of the inventive subject matter.

DETAILED DESCRIPTION OF THE INVENTION

Embodiments of the present invention resolve various safety and product management issues associated with conventional bushings by, for example, decreasing the opportunity for improperly mounting an abrasive wheel without the appropriate reducing bushing, simplifying the purchasing process, and/or reserving valuable SKU space for primary products. The abrasive wheel itself can be tailored to any number of purposes, such as grinding, cutting, and polishing. The bushing and techniques described herein can be used with any such abrasive wheels.

An example application is the case where a bushing configured in accordance with embodiment of the present invention allows a company (e.g., such as Saint-Gobain Abrasives, Inc) to provide a single grinding wheel product that can be used on all grinding machines (e.g., high-speed gas saw machines, or any other numerous arbor-based grinding machines). For instance, consider the example scenario where a company supplies 12 inch×⅛ inch abrasive cut-off wheels with both 20 millimeter and 1 inch arbor holes (i.e., 12"×⅛"×20 mm and 12"×⅛"×1"). With a reducing bushing as described herein, the company can supply, for example, only one wheel of size 12"×⅛"×1" that includes a 20 mm bushing pre-installed in its 1" arbor hole. Distributors/Retailers of the company's grinding wheel products only have to carry one SKU rather than three (one for a 20 mm arbor wheel, one of a 1 inch arbor wheel, and one for the bushing). This helps with inventory cost reduction and management, and customers don't have to worry about making a decision on which wheel to purchase for their machines as the wheel can fit on either a 20 mm or a 1 inch arbor.

Example Bushing Design

In one particular embodiment of the present invention, the bushing is designed to fit snugly into the grinding wheel arbor hole so that it will not fall out during shipping and handling, and will arrive in tact or "pre-installed" in the wheel at the delivery destination (e.g., retailer or end-user residence). Once purchased, the end-user can easily remove the bushing, if it is not required for the given equipment (which will be readily apparent), by pushing the bushing through the arbor hole of the wheel leaving only the grinding wheel arbor hole.

Figure 1A:
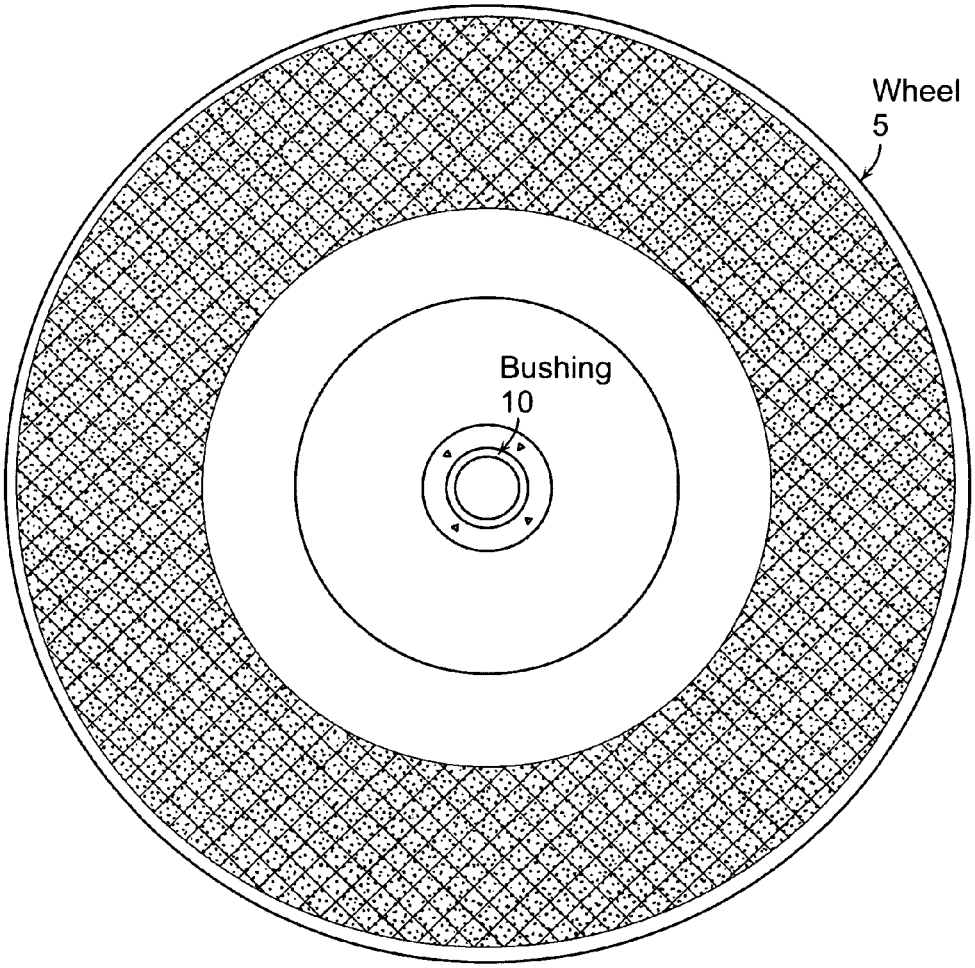
FIG. 1*a* shows an example grinding wheel with a bushing inserted into the wheel arbor hole, in accordance with one embodiment of the present invention.
Figure 1B:
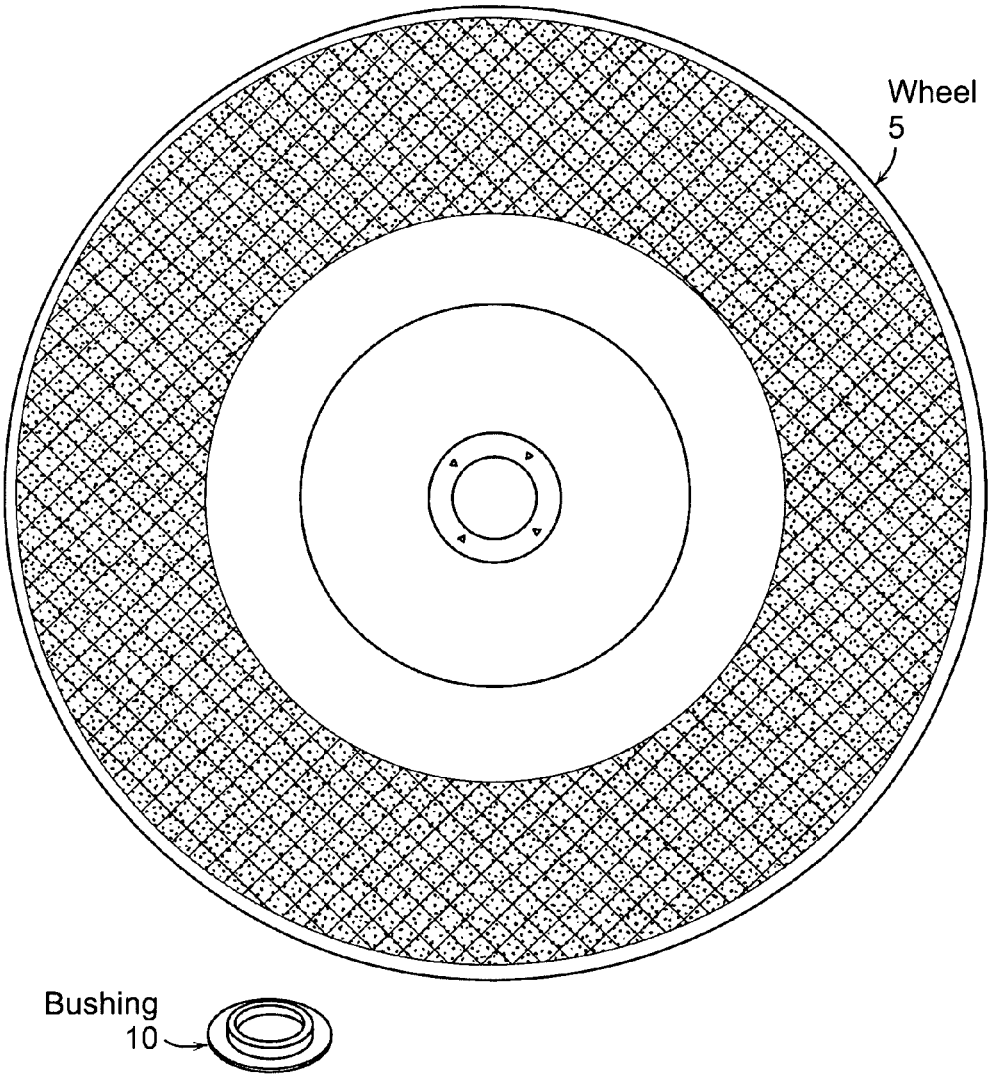
FIG. 1*b* shows the same grinding wheel without the bushing in the arbor hole but lying beside the wheel.

FIG. 1*a* shows an example wheel 5 with one embodiment of the universal bushing 10 inserted into the wheel arbor hole, and FIG. 1*b* shows the same wheel 5 without the bushing 10 in the arbor hole but lying beside the wheel 5. The wheel 5 in this example is a NORTON 12 inch cut-off blade. Note, however, that embodiments of the present invention can be used in conjunction with any abrasive wheels that can work on machines having multiple arbor sizes (e.g., 1 inch arbors and 20 mm arbors). In a more general sense, the various principles of the present invention can be applied to any device having an arbor hole.

Figure 2A:
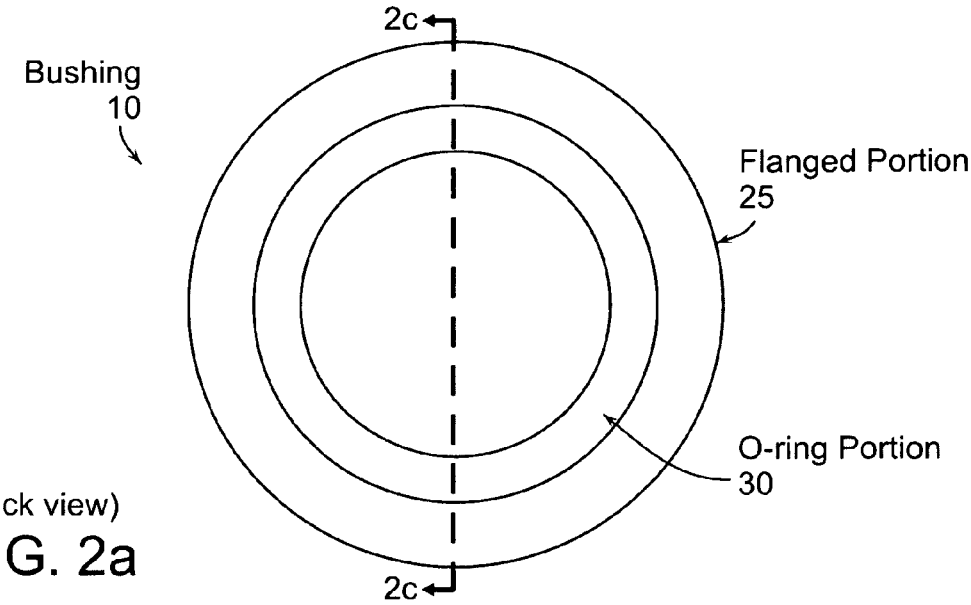
FIGS. 2*a*, 2*b*, and 2*c* illustrate back, front, and side views, respectively, of a universal bushing configured in accordance with one embodiment of the present invention.
Figure 2B:
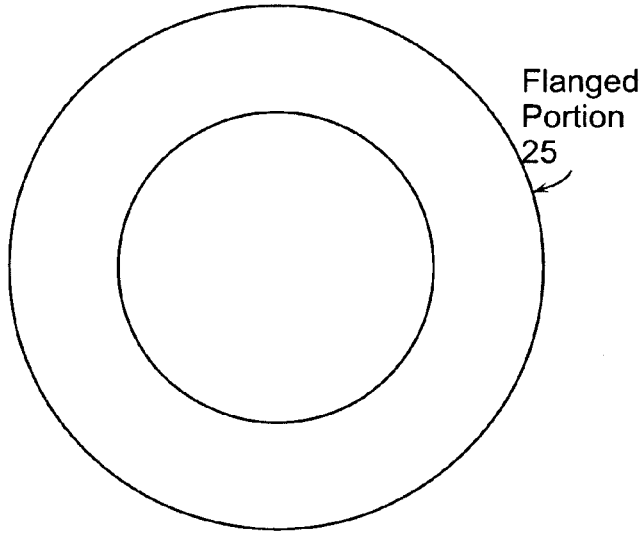
Figure 2C:
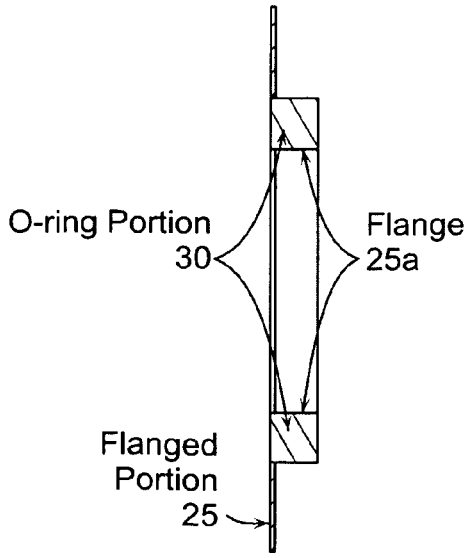

FIGS. 2*a*, 2*b*, and 2*c* illustrate back, front, and side views, respectively, of a universal bushing 10 configured in accordance with one embodiment of the present invention. As can be seen, the bushing 10 includes a flanged portion 25 and an O-ring portion 30. The two portions can be fabricated together as one integral piece, or separately and then assembled to form the bushing 10. In the particular embodiment shown, the flanged portion 25 is made from metal (which provides a degree of rigidity and robust structure), while the O-ring portion is made from plastic or rubber (which provides a degree of flexibility and resilience for facilitating insertion and removal of the bushing 10). As will be apparent in light of this disclosure, alternative embodiments of bushing 10 can be made from a single material, such as all plastic, rubber or some other suitable material that will simultaneously provide sufficient robustness and flexibility as discussed herein, if so desired.

The flanged portion 25 has a flange 25*a* that is bent or otherwise formed (e.g., pressed, molded, carved, etched, etc). This flanged portion 25 provides a self-aligning quality to the bushing during installation, wherein the flat part of the flanged portion 25 seats flush against the side of the wheel. The flange portion 25 can also be used to help prevent the bushing 10 from being pushed out of the arbor hole by forces associated with the mounting process (i.e., when the flat part of the flange is on the side of the wheel that is applied to the grinding machine arbor first during the mounting process). In one embodiment, portion 25 is formed from a metal material, such as aluminum, steel (e.g., stainless or carbon), or any other suitable metal. Known metal fabrication techniques can be used to form portion 25, such as pressing, stamping, punching, cutting, molding, and/or grinding.

The O-ring portion 30 has an inner diameter designed to couple with the outer diameter of flange 25*a*. An epoxy, cement, or other suitable adhesion mechanism can be used to secure the O-ring portion 30 in place about the flange 25*a*. The O-ring portion 30 can be made, for example, from a durable plastic material (e.g., PVC) or rubber, and can be formed by known processes such as injection molding, pressing, extrusion, carving, etching, and/or cutting. In some embodiments, the O-ring portion 30 may include a friction reducing component to facilitate its removal and installation into the arbor hole of the wheel, such as graphite or silicon. Such friction reducing components are particularly useful with metallized arbor holes.

Figure 3A:
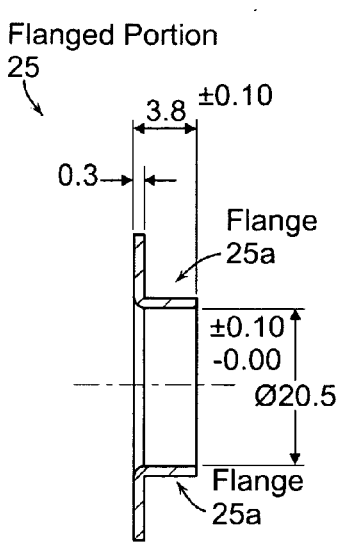
FIGS. 3*a* and 3*b* illustrate detailed side and front views, respectively, of a flanged portion of a universal bushing configured in accordance with one embodiment of the present invention.
Figure 3B:
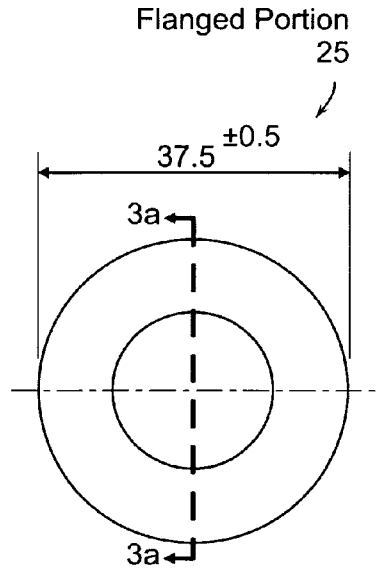
Figure 4A:
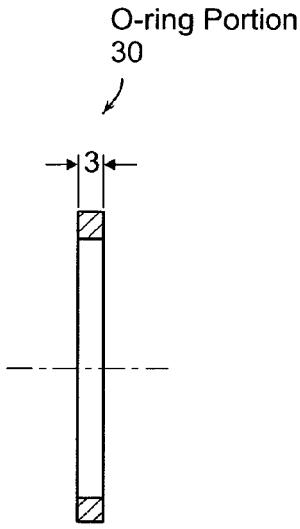
FIGS. 4*a* and 4*b* illustrate detailed cross-section side and front views, respectively, of an O-ring portion of a universal bushing configured in accordance with one embodiment of the present invention.
Figure 4B:
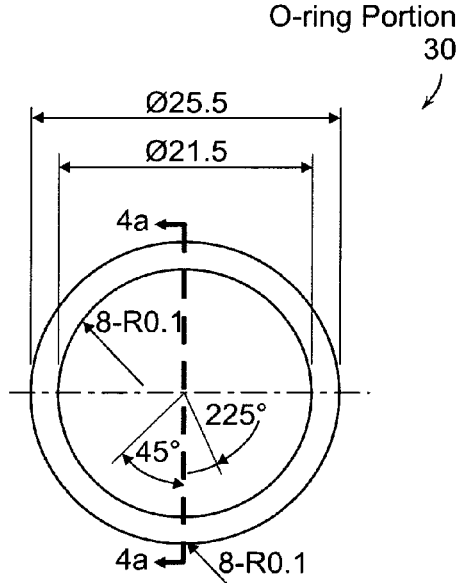

FIGS. 3*a* and 3*b* illustrate detailed side and front views, respectively, of an example flanged portion 25 of universal bushing 10 configured in accordance with one embodiment of the present invention. FIGS. 4*a* and 4*b* illustrate detailed cross-section side and front views, respectively, of an example O-ring portion 30 of universal bushing 10 configured in accordance with one embodiment of the present invention. As previously indicated, these two portions can be implemented in one integral piece (e.g., formed with plastic or rubber using molding techniques), or in two separate pieces (e.g., metal flanged portion 25 and plastic O-ring portion 30) that are bonded or otherwise fastened together to form the bushing 10. Bonding of the two separate pieces can be established, for example, chemically (e.g., via glue or epoxy) or mechanically (e.g., snap-fitting). As will be apparent in light of this disclosure, bushing 10 can be implemented using various materials, dimensions, and fabrication schemes to satisfy the given application specific details.

Example dimensions (in millimeters, or degrees) are also shown in FIGS. 3*a* through 4*b*. These dimensions are merely provided as one specific example embodiment that can be fabricated. However, it will be readily apparent in light of this disclosure that numerous dimensions, as well as bushing configurations can be used to implement a bushing 10 in accordance with an embodiment of the present invention. The present invention is not intended to be limited to any particular set or range of blade dimensions or configurations.

Once inserted into the corresponding abrasive wheel product, the bushing 10 will remain in place until purposefully removed with a degree of applied but gentle force (e.g., pushed out with end-user's finger or other wheel-friendly implement so as to not compromise the integrity of the arbor hole). For instance, the bushing will not fall out during shipping, handling, or mounting but can be safely removed by the end-user for applications that do not require the bushing 10. Note that the user will immediately know the bushing 10 is not required, because in such cases, the wheel with the pre-installed bushing 10 will not fit onto the grinding machine spindle.

No special tools are needed to remove the bushing, but any number of suitable implements can be used if so desired (e.g., plastic or wooden push-stick). With reference to the embodiment shown in FIGS. 1*a* and 1*b*, the gentle force applied by the user to remove the bushing 10 from example wheel 5 is in the range of about 2 pounds (lbs), applied over a period of 1 to 5 seconds. Given the area of the arbor hole of wheel 5 being about 0.4 $inch^2$ (pi=arbor diameter=arbor thickness, where arbor diameter is 1 inch and arbor thickness is ⅛ inch), this 2 lb force translates to about 5 pounds per square inch (psi), which is computed by dividing the applied force of 2 lbs by the arbor hole area of 0.4 $inch^2$. In general, the force required to remove the bushing 10 will depend on factors such as the area of the arbor hole, as well as the snugness and the composition of the bushing 10. In other embodiments, the gentle force applied by the user to remove the bushing 10 is in the range of 10 psi or less (e.g., anywhere from about 1.0 psi to about 8 psi, or even more specifically, from about 0.5 psi to about 5 psi), for a time period in the range of about 1 to 10 seconds. This gentle force can be generally described as shear stress under static loading that is delivered over a period of time.

Such purposeful removal of the bushing 10 is to be distinguished from an arbor hole design that includes a 'knock-out' portion which requires a relatively more violent force (shear stress under dynamic loading, typically delivered by a hammer or other high impact implement), as compared to the gentle force a user can use to remove bushing 10 (shear stress under static loading delivered over a longer duration). Likewise, such purposeful removal of the bushing 10 is to be distinguished from an arbor hole design that includes a mechanical arrangement that requires relatively high torque twisting forces (such as those delivered by a wrench or other such tool) to facilitate removal and installation.

SKU Space Saver

As previously explained, by pre-installing the bushing 10 into the grinding wheel, a lower number of SKUs are needed to sell the primary abrasive product. For vendors dealing with retailers that limit the number of SKUs given to any one vendor, such an embodiment of the present invention provides a mechanism to optimize SKU usage.

Consider, for example, a major retail store (e.g., Home Depot or Lowe's) that sells home improvement products (including abrasive wheels) to do-it-yourselfers and contractors. Further, assume that each store allows 6 SKUs per vendor for the abrasive wheels product range, and that Vendor A has 6 abrasive wheel products each having a bushing. Without a pre-installed universal bushing 10 as described herein, Vendor A would only be able to sell 3 of its 6 abrasive wheel products (the other three SKUs would be needed for the three adapter bushings that correspond to the three wheels). Alternatively, the Vendor could sell 6 abrasive wheels and simply not offer bushings. In either case, the Vendor is limited to providing wheels for 6 potentially distinct grinding applications On the other hand, using the pre-installed universal bushing 10 as described herein would allow Vendor A to sell all 6 of its abrasive wheel products to the retail store. Thus, the Vendor would be able to provide wheels for up to 12 potentially distinct grinding applications. This amounts to a 100% increase in primary products that can be marketed and sold to the retailer by Vendor A. In addition, use of the pre-installed universal bushing 10 frees up valuable shelf space at the retailer's store, thereby making the product even more attractive to the retailer.

The foregoing description of the embodiments of the invention has been presented for the purposes of illustration and description. It is not intended to be exhaustive or to limit the invention to the precise form disclosed. Many modifications and variations are possible in light of this disclosure. It is intended that the scope of the invention be limited not by this detailed description, but rather by the claims appended hereto.

What is claimed is:

1. An abrasive product comprising:

an abrasive wheel having an arbor hole designed to fit a machine having a first arbor size, the abrasive wheel also having a first side and a second side opposite the first side; and a removable reduction bushing having an unthreaded bore and pre-installed in the arbor hole of the abrasive wheel on the first side, for adapting the abrasive wheel to fit on a machine having a second arbor size;

wherein the pre-installed removable reduction bushing will not fall out of the arbor hole unless purposefully removed by applying a shear stress of 10 pounds per square inch or less under static loading for a time period in the range of about 1 to 10 seconds.

2. The abrasive product of claim 1 wherein the abrasive product is associated with a single product identification code at a retail store that sells abrasive products.

3. The abrasive product of claim 2 wherein the single product identification code is a stock keeping unit (SKU) or universal product code (UPC), and the single product identification code does not appear on the removable reduction bushing.

4. The abrasive product of claim 1 wherein the removable reduction bushing further comprises:

a flanged portion having an inner diameter equivalent to a diameter of the smooth bore; and an O-ring portion about the flanged portion, wherein the O-ring portion fits snugly in the arbor hole.

5. The abrasive product of claim 4 wherein the flanged portion is made from metal and the O-ring portion is made from plastic or rubber, and the two portions are securely coupled together.

6. The abrasive product of claim 4 wherein the O-ring portion includes a friction reducing component.

7. The abrasive product of claim 4 wherein the flanged portion and the O-ring portion are integral to one another.

8. The abrasive product of claim 1 wherein the first arbor size is associated with a first diameter and the second arbor size is associated with a second diameter, and the first diameter is within 5 millimeters or less of the second diameter.

9. The abrasive product of claim 1 wherein the pre-installed removable reduction bushing will not fall out of the arbor hole unless purposefully removed by applying a shear stress of 5 pounds per square inch or less under static loading for a time period in the range of about 1 to 5 seconds.

10. An abrasive product comprising:

an abrasive wheel having an arbor hole designed to fit a machine having a first arbor size, the abrasive wheel also having a first side and a second side opposite the first side; and a removable reduction bushing having an unthreaded bore and pre-installed in the arbor hole of the abrasive wheel on the first side, for adapting the abrasive wheel to fit on a machine having a second arbor size;

wherein the pre-installed removable reduction bushing fits snugly into the arbor hole so that it will not fall out, but wherein the reduction bushing can be removed from the arbor hole by the application of a shear stress of 10 pounds per square inch or less under static loading for a time period in the range of about 1 to 10 seconds.

* * * * *